US007621855B1

(12) United States Patent
Krull

(10) Patent No.: US 7,621,855 B1
(45) Date of Patent: Nov. 24, 2009

(54) EXERCISE DUMBBELL METHODS AND APPARATUS

(76) Inventor: Mark A. Krull, P.O. Box 7198, Bend, OR (US) 97708

( * ) Notice: Subject to any disclaimer, the term of this patent is extended or adjusted under 35 U.S.C. 154(b) by 737 days.

(21) Appl. No.: 11/029,845

(22) Filed: Jan. 4, 2005

Related U.S. Application Data

(60) Provisional application No. 60/539,761, filed on Jan. 27, 2004.

(51) Int. Cl.
*A63B 21/075* (2006.01)

(52) U.S. Cl. ..... 482/107; 482/108

(58) Field of Classification Search ..... 482/104–18, 482/92–94
See application file for complete search history.

(56) References Cited

U.S. PATENT DOCUMENTS

| | | | | |
|---|---|---|---|---|
| 3,771,785 | A | 11/1973 | Speyer | 482/106 |
| 4,529,198 | A | 7/1985 | Hettick, Jr. | 272/123 |
| 4,822,034 | A | 4/1989 | Shields | 272/123 |
| 5,284,463 | A | 2/1994 | Shields | 482/107 |
| 5,637,064 | A | 6/1997 | Olson et al. | 482/108 |
| 5,769,762 | A | 6/1998 | Towley, III | 482/93 |
| 5,839,997 | A | 11/1998 | Roth | 482/107 |
| 6,033,350 | A | 3/2000 | Krull | 482/98 |
| 6,099,442 | A | 8/2000 | Krull | 482/107 |
| 6,228,003 | B1 | 5/2001 | Hald | 482/107 |
| 6,322,481 | B1 | 11/2001 | Krull | 482/107 |
| 6,540,650 | B1 | 4/2003 | Krull | 482/107 |
| 6,656,093 | B2 | 12/2003 | Chen | 482/108 |

*Primary Examiner*—Jerome Donnelly

(57) ABSTRACT

An exercise dumbbell includes a handle member and weight plates maintained in spaced relationship at opposite ends thereof. Weight selectors are movable into and out of engagement with different combinations of the weight plates to secure a desired amount of mass to the handle. The weight selectors are routed through the hand grip portion of the handle member, and are accessible via upwardly opening slots in the weight plates. Different latching arrangements may be used to releasably latch the weight selectors in desired locations relative to the weight plates.

14 Claims, 9 Drawing Sheets

EXERCISE DUMBBELL METHODS AND APPARATUS

CROSS-REFERENCE TO RELATED APPLICATIONS

Disclosed herein is subject matter that was previously disclosed in U.S. Provisional Application No. 60/539,761, filed on Jan. 27, 2004, and U.S. Provisional Application No. 60/428,890, filed on Nov. 22, 2002.

FIELD OF THE INVENTION

The present invention relates to exercise equipment and in a preferred application, to methods and apparatus for adjusting weight on exercise dumbbells.

BACKGROUND OF THE INVENTION

Past efforts have led to various inventions directed toward adjustable weight exercise devices. Some examples of such efforts in the field of free weights are disclosed in U.S. Pat. No. 3,771,785 to Speyer; U.S. Pat. No. 4,529,198 to Hettick, Jr.; U.S. Pat. No. 4,822,034 to Shields; U.S. Pat. No. 4,284,463 to Shields; U.S. Pat. No. 5,637,064 to Olson et al.; U.S. Pat. No. 5,769,762 to Towley, III et al.; U.S. Pat. No. 5,839,997 to Roth et al.; U.S. Pat. No. 6,033,350 to Krull; U.S. Pat. No. 6,099,442 to Krull; U.S. Pat. No. 6,228,003 to Hald, et al.; U.S. Pat. No. 6,322,481 to Krull; U.S. Pat. No. 6,540,650 to Krull; and U.S. Pat. No. 6,656,093 to Chen. Despite these advances and others in the field of weight lifting equipment, room for continued improvement remains with respect to selecting different combinations of weight for use on exercise dumbbells and the like.

SUMMARY OF THE INVENTION

The present invention provides methods and apparatus involving the movement of mass subject to gravitational force. In a preferred application, the present invention allows a person to adjust weight resistance by securing desired amounts of mass to a handlebar or other weight lifting member. A preferred embodiment of the present invention may be described in terms of exercise dumbbells. One such dumbbell comprises a handle member having a first weight supporting section, a second weight supporting section, and a handle that extends therebetween and defines a longitudinal axis. Bars extend axially through respective weight supporting sections. First weights are sized and configured to be supported by the first weight supporting section, and have upwardly opening slots that accommodate insertion of a respective bar. Similarly, second weights are sized and configured to be supported by the second weight supporting section, and have upwardly opening slots that accommodate insertion of a respective bar. A first weight selector is routed through the handle and configured and arranged to selectively engage the first weights. Similarly, a second weight selector is routed through the handle and configured and arranged to selectively engage the second weights. On one embodiment, operational access to the first selector is provided via the slots in the second weights, and operational access to the second selector is provided via the slots in the first weights. Many features and/or advantages of the present invention will become apparent from the more detailed description that follows.

BRIEF DESCRIPTION OF THE FIGURES OF THE DRAWING

With reference to the Figures of the Drawing, wherein like numerals represent like parts and assemblies throughout the several views.

DETAILED DESCRIPTION OF A PREFERRED EMBODIMENT

Figure 1:
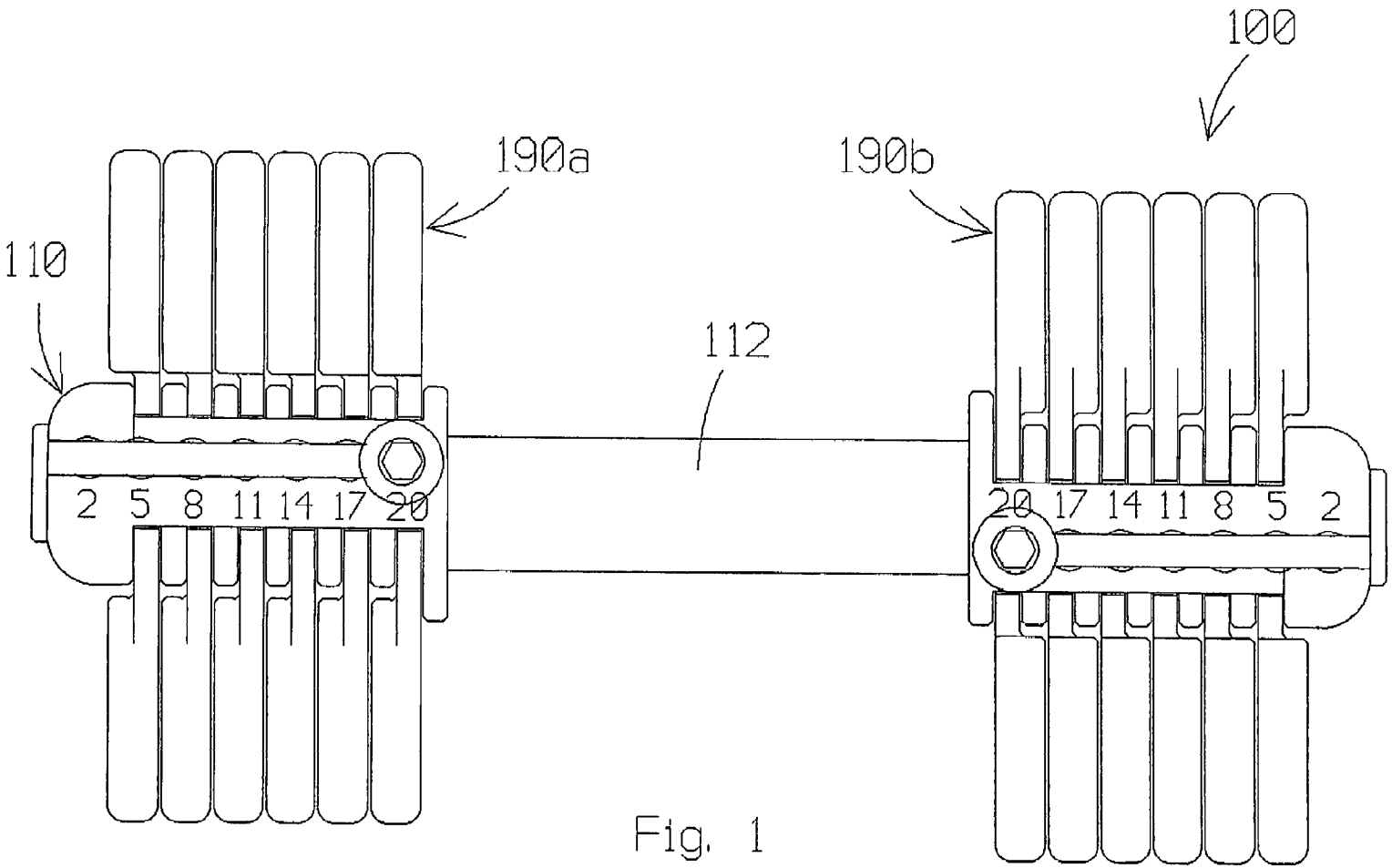
FIG. 1 is a top view of an exercise dumbbell constructed according to the principles of the present invention.
Figure 2:
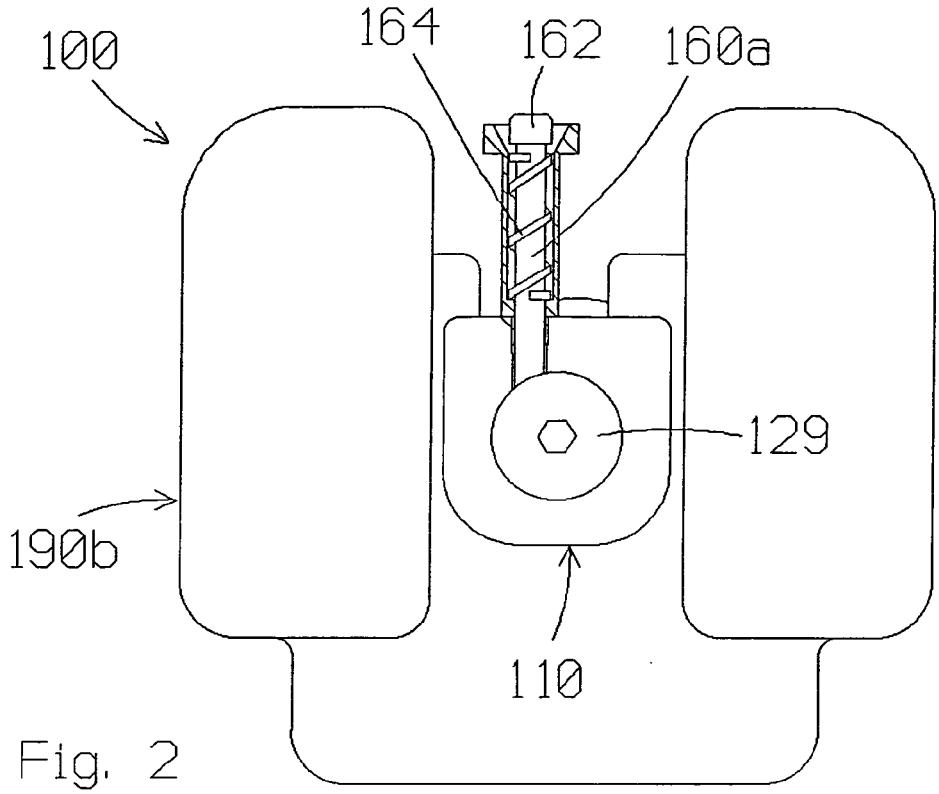
FIG. 2 is an end view of the dumbbell of FIG. 1.
Figure 10:
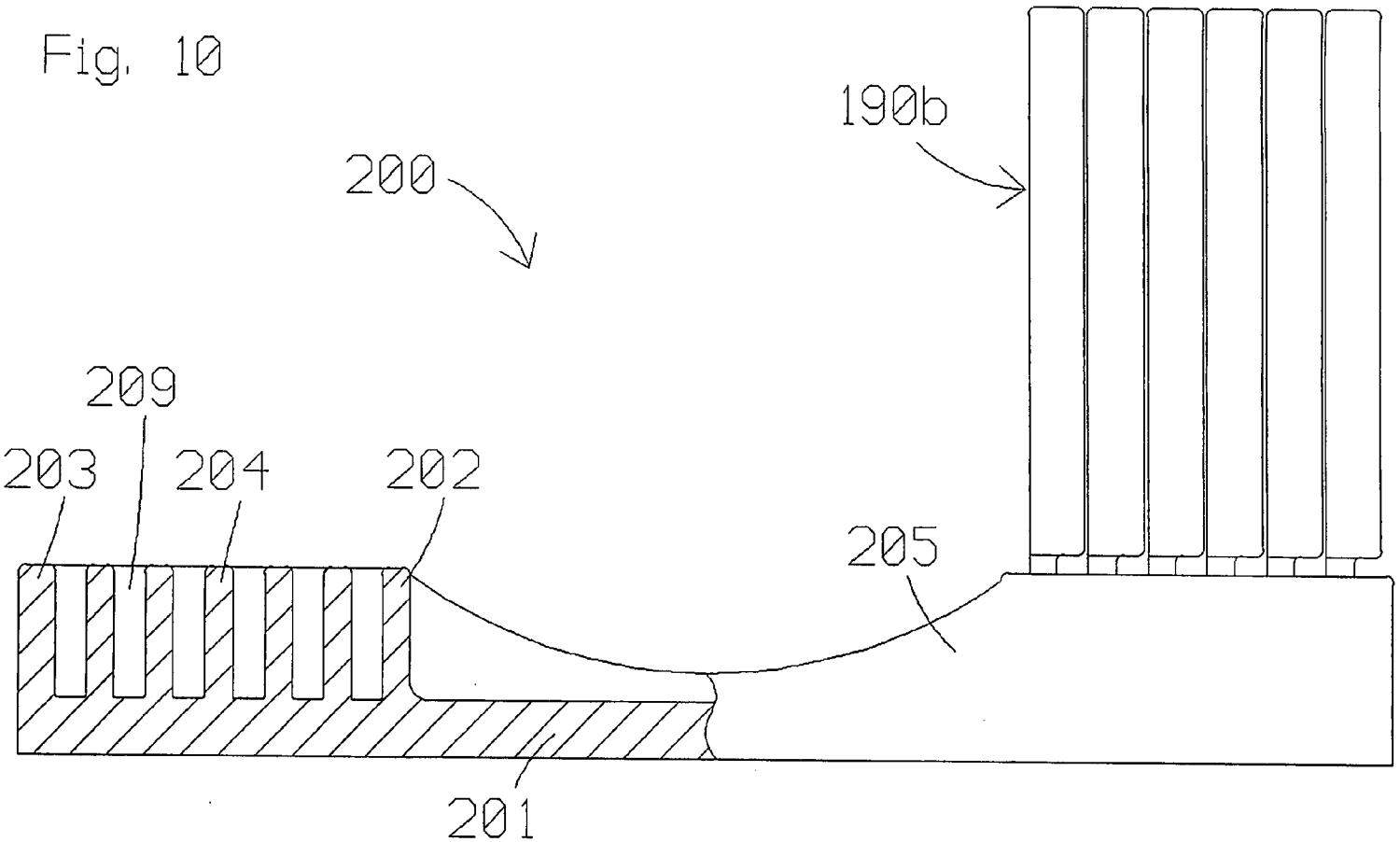
FIG. 10 is a partially sectioned side view of a weight cradle configured for use with the dumbbell of FIG. 1.

FIGS. 1-2 show an exercise dumbbell constructed according to the principles of the present invention and designated as 100. The dumbbell 100 includes a weight lifting member or handle member 110, and a plurality of weight plates 190*a* and 190*b* that are selectively secured to the handle member 110. In a manner known in the art, the weight plates 190 are preferably supported by a base or cradle 200 when not in use (as shown in FIG. 10). Other suitable weight supporting bases are disclosed in the patents identified in the Background of the Invention, which are incorporated herein by reference (both for purposes of providing additional information about suitable bases, and for providing additional information about other conventional aspects of the dumbbells constructed according to the principles of the subject invention).

The handle member 110 includes a handle portion or hand grip 112 and first and second weight supporting sections 120*a* and 120*b* disposed at opposite ends of the hand grip 112. The hand grip 112 and the weight supporting sections 120*a* and 120*b* are shown as a unitary part, but they could be made from a plurality of components in the alternative. The hand grip 112 is preferably a cylindrical member that defines a longitudinal axis. The term "axially" is used herein to describe a direction parallel to this longitudinal axis (not necessarily along the axis itself), and the terms "transversely" and "laterally" are used herein to describe a direction perpendicular to this axis (not necessarily in a common plane or intersecting the axis).

Each weight supporting section 120*a* and 120*b* includes an inboard support 122 proximate the hand grip 112, an outboard support 123 proximate a respective end of the handle member 110, and a plurality of intermediate supports 124 disposed therebetween. Adjacent supports 122, 123, and 124 cooperate to define weight receiving gaps therebetween. A respective bar 121 extends axially through each weight supporting section 120*a* and 120*b*, interconnecting the various supports 122, 123, and 124 and spanning the intervening gaps. On an alternative embodiment, each bar 121 may be a respective end of a single bar that extends through the hand grip and supports the various components of the handle member.

Figure 5:
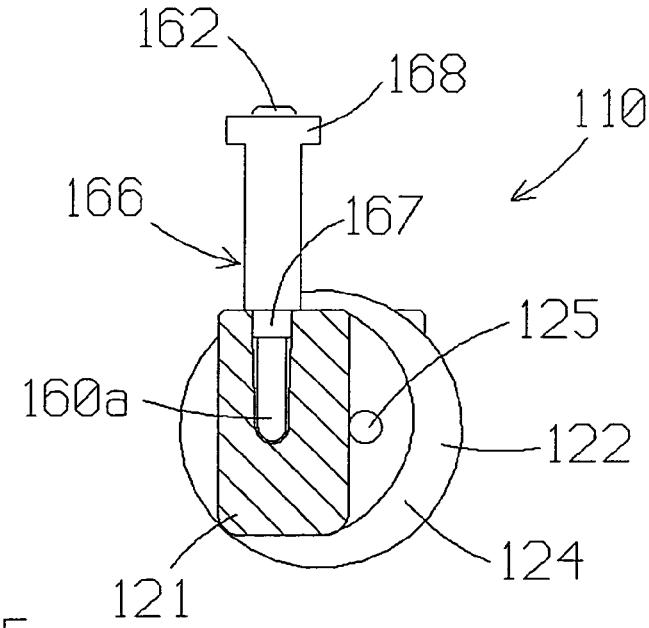
FIG. 5 is a partially sectioned end view of the handle portion of FIGS. 3-4 (taken along section line 5-5)

A respective, upwardly opening channel 126 extends through the bar portion 121 of each weight supporting section 120*a* and 120*b*. Also, as suggested by FIG. 5, a respective bore 125 extends through each weight supporting section 120*a* and 120*b*. The bore 125 is disposed adjacent the bar 121, and extends through the inboard support 122 and the intermediate supports 124 and into the outboard support 123. The bore 125 in the first weight supporting section 120*a* extends through the hand grip 112, as well, and aligns with the channel 126 in the second weight supporting section 120*b*. Similarly, the bore 125 in the second weight supporting section 120*b* also extends through the hand grip 112, and aligns with the channel 126 in the first weight supporting section 120*a*.

As suggested by FIG. 2, each channel 126 extends through the associated outboard support 123 to facilitate construction of the handle member 110. In this regard, a first L-shaped selector 160*a* has a longer end portion that is inserted into the channel 126 in the second weight supporting section 120*b* and into the aligned bore 125 in the hand grip 112 and the first weight supporting section 120*a*, and a shorter end portion that extends upward out of the channel 126 in the second weight supporting section 120*b*. Similarly, a second L-shaped selector 160*b* has a longer end portion that is inserted into the channel 126 in the first weight supporting section 120*a* and into the aligned bore 125 in the hand grip 112 and the second weight supporting section 120*b*, and a shorter end portion that extends upward out of the channel 126 in the first weight supporting section 120*a*. A bolt or other fastener 129 is then secured to each end of the handle member 110 in a manner that covers at least a portion of a respective channel 126, thereby discouraging removal of a respective selector 160*a* or 160*b*.

A separate knob, plunger, or other operator member 166 is movably mounted on the upwardly extending end of a respective selector 160*a* or 160*b*. Each plunger 166 may be described as a tube having a relatively large diameter, upper end 168 that is configured for grasping by a user, and a relatively small diameter, lower end 167 (see FIG. 5) that is configured to fit into any of several circular depressions 127 in a respective weight supporting section 120*a* or 120*b*. As shown in FIG. 2, a helical coil spring 164 is disposed on the upwardly extending end of the selector 160*a* or 160*b*, and compressed between an internal lip on the plunger 166 and a nut or other fastener 162 mounted on an upper distal end of the selector 160*a* or 160*b*. The spring 164 biases the plunger 166 downward into engagement with one of the depressions 127, in which case, the associated selector 160*a* or 160*b* is latched against axial movement relative to the weight supporting sections 120*a* and 120*b*. In other words, a user must pull upward on the plunger 166 to free the associated selector 160*a* or 160*b* for axial movement.

Figure 3:
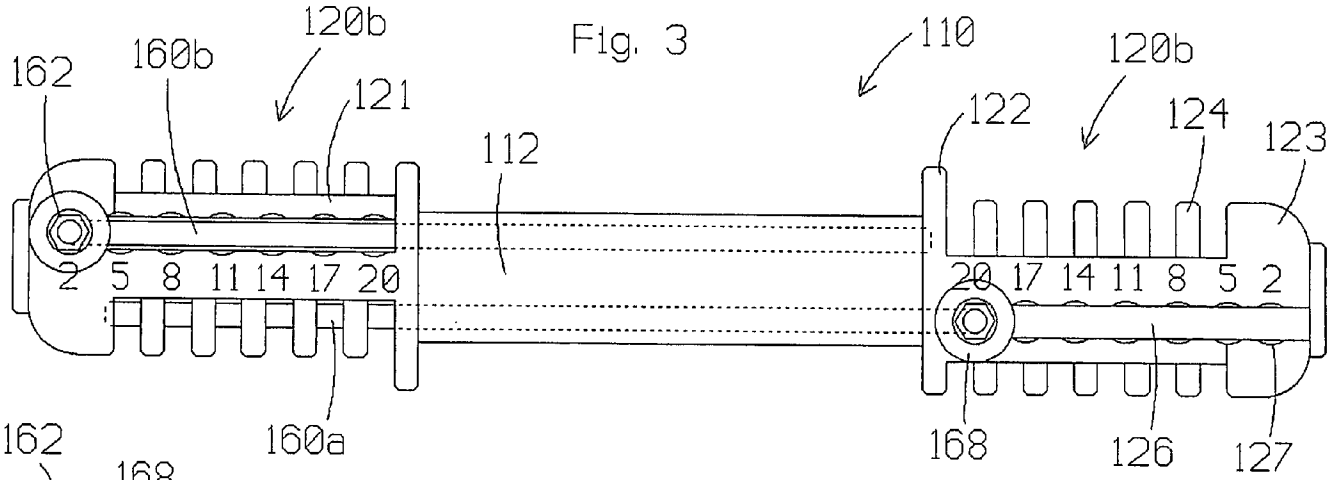
FIG. 3 is a top view of a handle portion of the dumbbell of FIG. 1.
Figure 4:
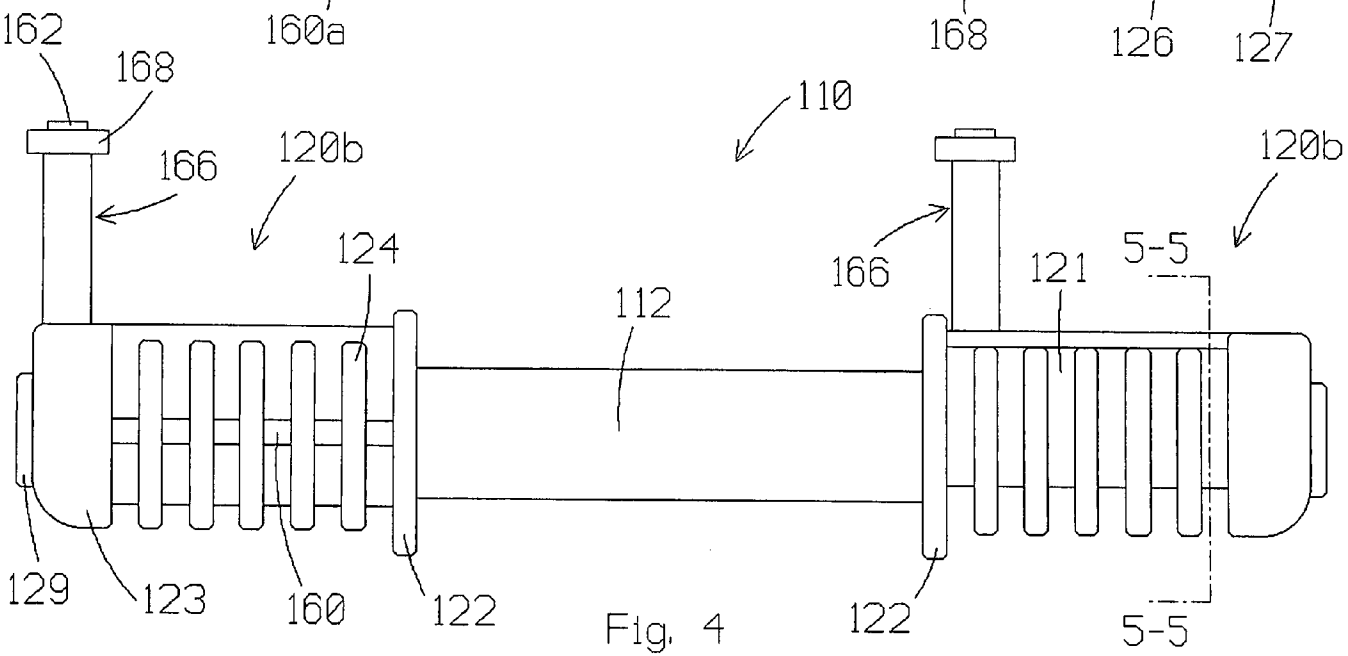
FIG. 4 is a side view of the handle portion of FIG. 3.
Figure 9:
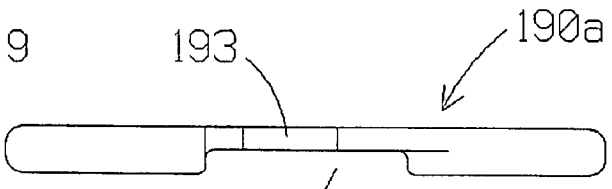
FIG. 9 is a top view of the weight plate of FIG. 8.
Figure 8:
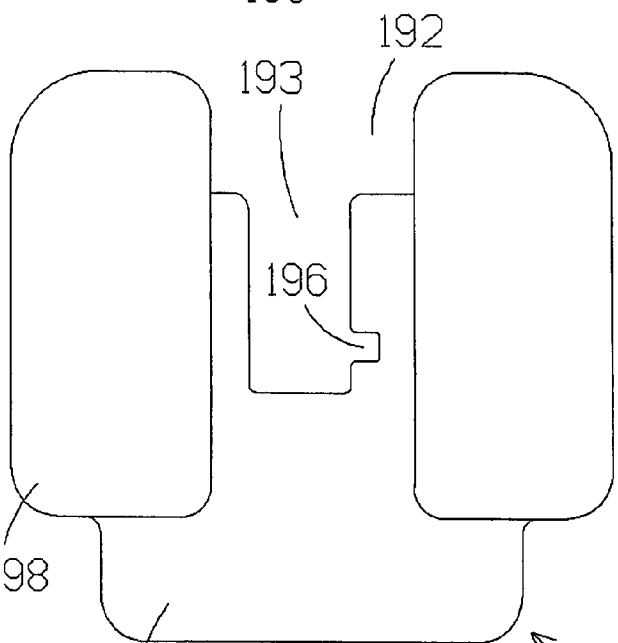
FIG. 8 is an opposite end view of the weight plate of FIG. 7.
Figure 6:
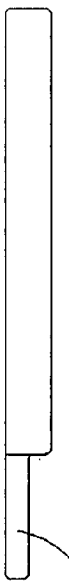
FIG. 6 is a side view of a weight plate on the dumbbell of FIG. 1.
Figure 7:
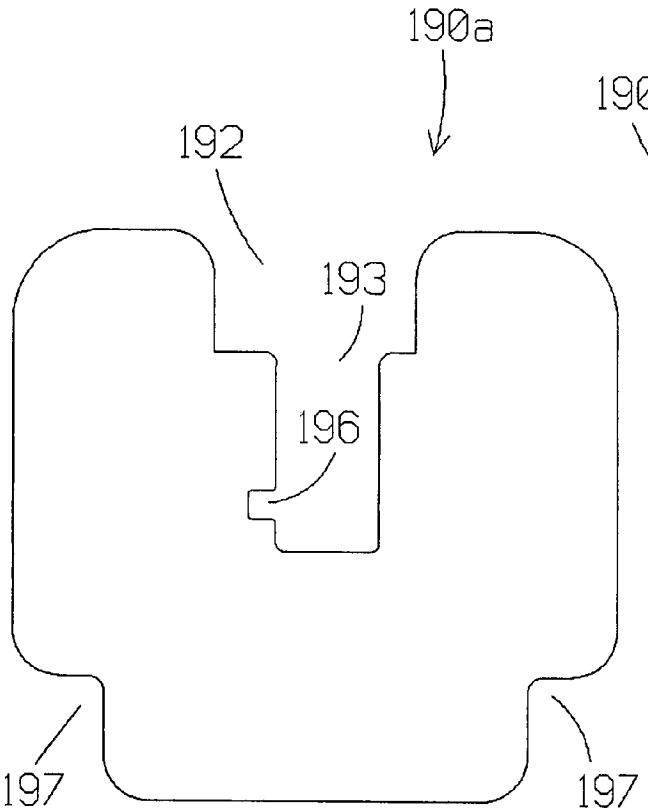
FIG. 7 is an end view of the weight plate of FIG. 6.

Indicia are provided on the weight supporting sections 120*a* and 120*b* to associate respective plunger locations with respective dumbbell weights. For example, FIGS. 3-4 show the selector 160*a* occupying a maximum weight position of 20 pounds, and the selector 160*b* occupying a minimum weight position of two pounds (the weight of the empty handle member 110). As suggested by the indicia on the weight supporting sections 120*a* and 120*b*, when both plungers 166 are moved to their respective maximum weight positions (as shown in FIG. 1), the dumbbell 100 will be fully loaded and will weigh twenty pounds when lifted from the cradle 200, and when both plungers 166 are moved to their respective minimum weight positions, the dumbbell 100 will be entirely free of weight plates and will weigh two pounds when lifted from the cradle 200.

FIGS. 6-9 show one of the weight plates 190*a* in greater detail. All of the weight plates 190*a* and 190*b* are identical to one another, but the first end plates 190*a* and the second end plates 190*b* are arranged to face in opposite directions. Each weight plate 190*a* and 190*b* includes a central plate 191 having an axially measured thickness that is preferably slightly less than the axially measured distance between adjacent supports 122-124 on the handle member 110. Each weight plate 190*a* and 190*b* also has opposite side shoulders or ears 198 that are approximately twice as thick as the central plate 191, and that define a gap 199 therebetween. The difference in thickness between the ears 198 and the central plate 191 is preferably slightly less than the axially measured thickness of the supports 124. Also, the transversely measured distance between the ears 198 (the width of the gap 199) is slightly greater than the transversely measured width of the supports 123-124. In other words, the supports 123 are configured to fit between adjacent weight plates 190*a* or 190*b* with relatively little wasted space therebetween.

A relatively wide, upwardly opening slot 192 is defined between the ears 198 and above the central plate 191 to accommodate operation of a plunger 166 by a user of the dumbbell 100. A relatively narrower, upwardly opening slot 193 is defined in the central plate 191 to accommodate both insertion of a bar 121 and axial travel of a selector 160*a* or 160*b*. The transversely measured width of the narrower slot 193 is preferably slightly greater than the transversely measured width of the bar 121 to accommodate insertion of the bars 121 into respective weight plates 190*a* and 190*b*.

A transversely extending notch 196 extends through the central plate 191 and opens laterally into the narrower slot 193. The transversely measured dimensions of the notch 196 are preferably slightly greater than the outside dimensions of a selector 160*a* or 160*b*. Also, the notch 196 is arranged to align with a respective bore 125 when the bar 121 is fully inserted into the slot 193. In other words, the notch 196 is configured to accommodate insertion of a respective selector 160*a* or 160*b*, thereby connecting the associated weight plate 190*a* or 190*b* to the handle assembly 110.

The weight plates 190*a* and 190*b* have notches 197 that are defined beneath the ears 198 outside the central plate 191. These notches 197 help "round" the lower corners of the weight plates 190*a* and 190*b*, raise the center of mass to help offset the effect of the slots 192 and 193, and reduce the "footprint" of the cradle 200 needed to hold the weight plates 190*a* and 190*b*.

As shown in FIG. 10, the cradle or base 200 includes a bottom wall 201 configured to support the mass of the weight plates 190*a* and 190*b*. At each end of the cradle 200, inner and outer end walls 202 extend upward from the bottom wall 201 and cooperate with opposite side walls 205 to define respective weight compartments. Intermediate walls 204 extend upward from the bottom wall 201 and inward from the side walls 205 to define respective weight slots 209 that are sized and configured to receive the plate portion 191 of respective weight plates 190*a* and 190*b*. The walls 201-203 on the cradle 200 are configured and arranged to align with respective supports 122-124 on the handle member 110.

The dumbbell 100 may be considered advantageous to the extent that only a single type of weight plate is required, only a single, simple motion is required to adjust the weight at a respective end of the dumbbell, the adjustment mechanism is accessible from above, the dumbbell is relatively compact and easy to use, and/or the design is adaptable to accommodate a variety of weight ranges.

Figure 11:
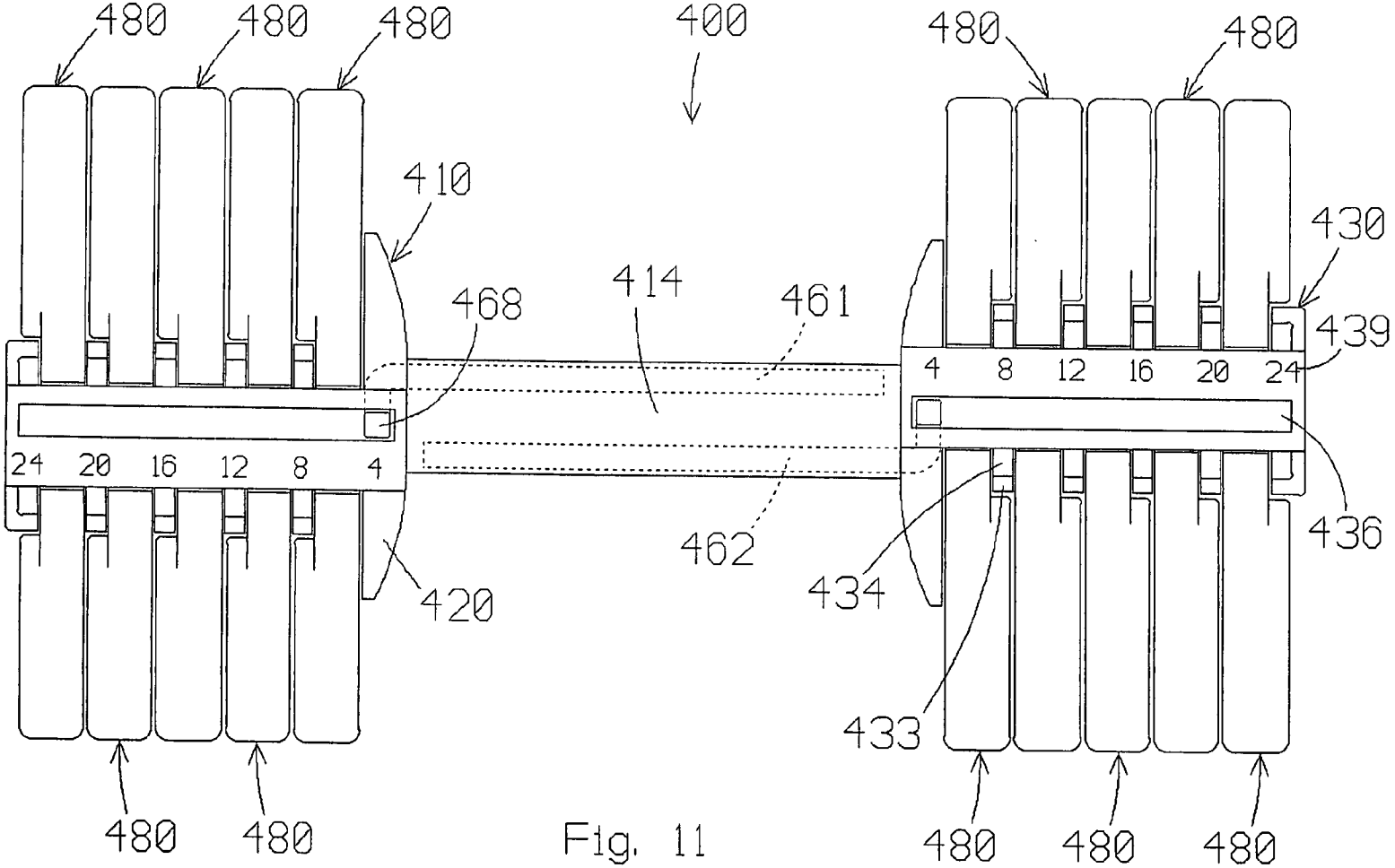
FIG. 11 is a top view of another dumbbell constructed according to the principles of the present invention.
Figure 12:
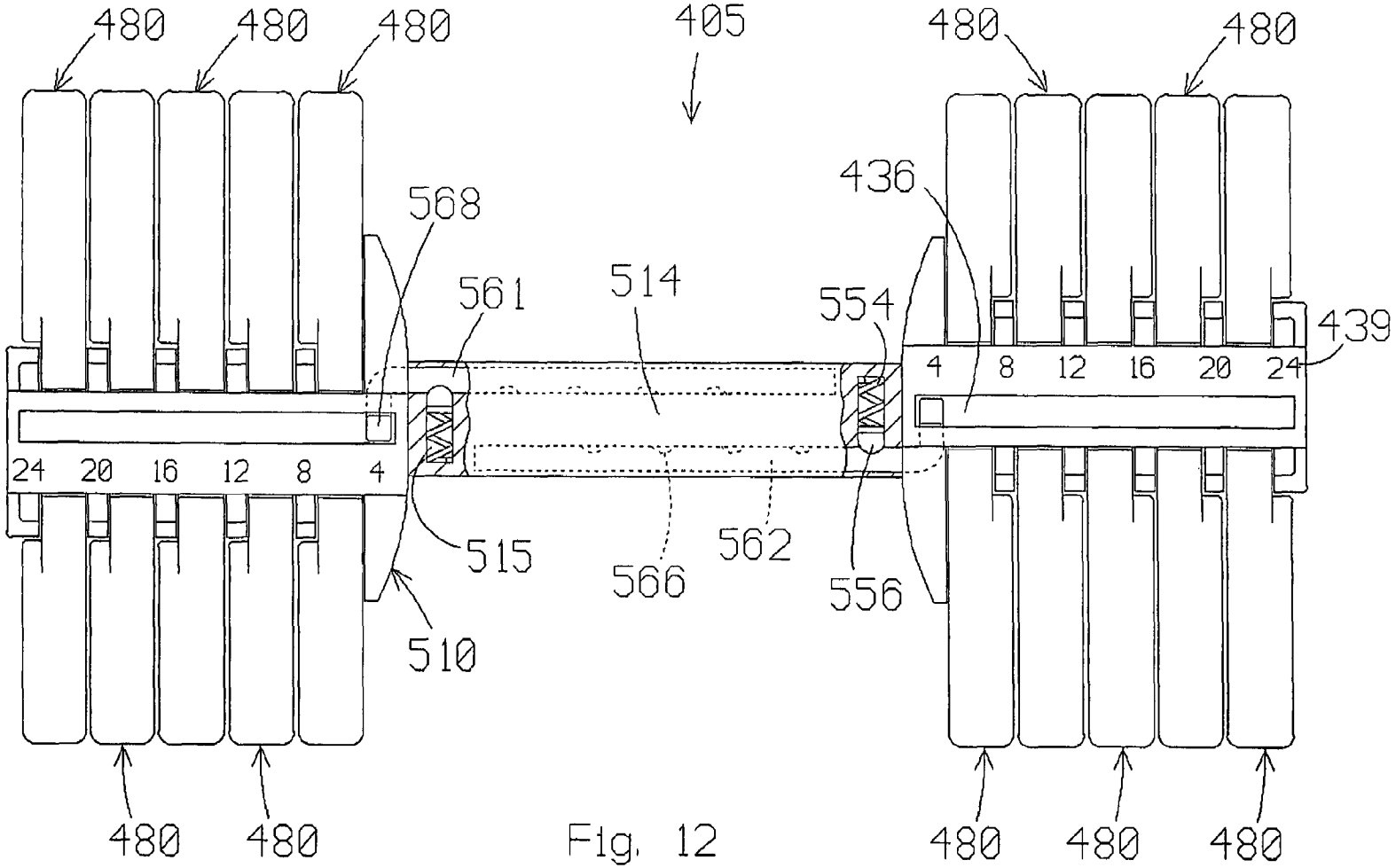
FIG. 12 is a partially sectioned top view of the dumbbell of FIG. 11 modified to include a first weight selector latching arrangement.
Figure 13:
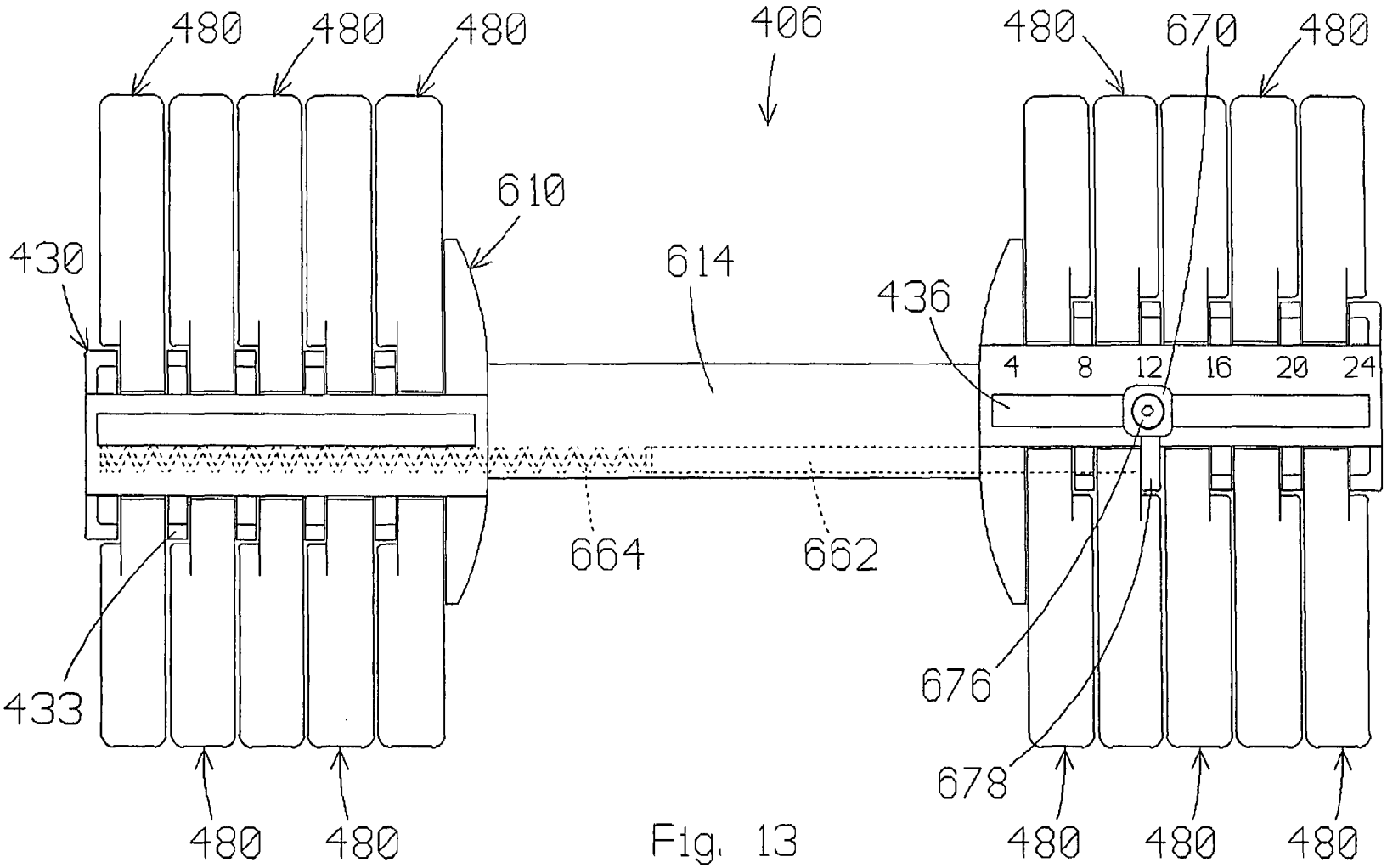
FIG. 13 is a top view of the dumbbell of FIG. 11 modified to include a second weight selector latching arrangement, and shown only partially assembled.
Figure 14:
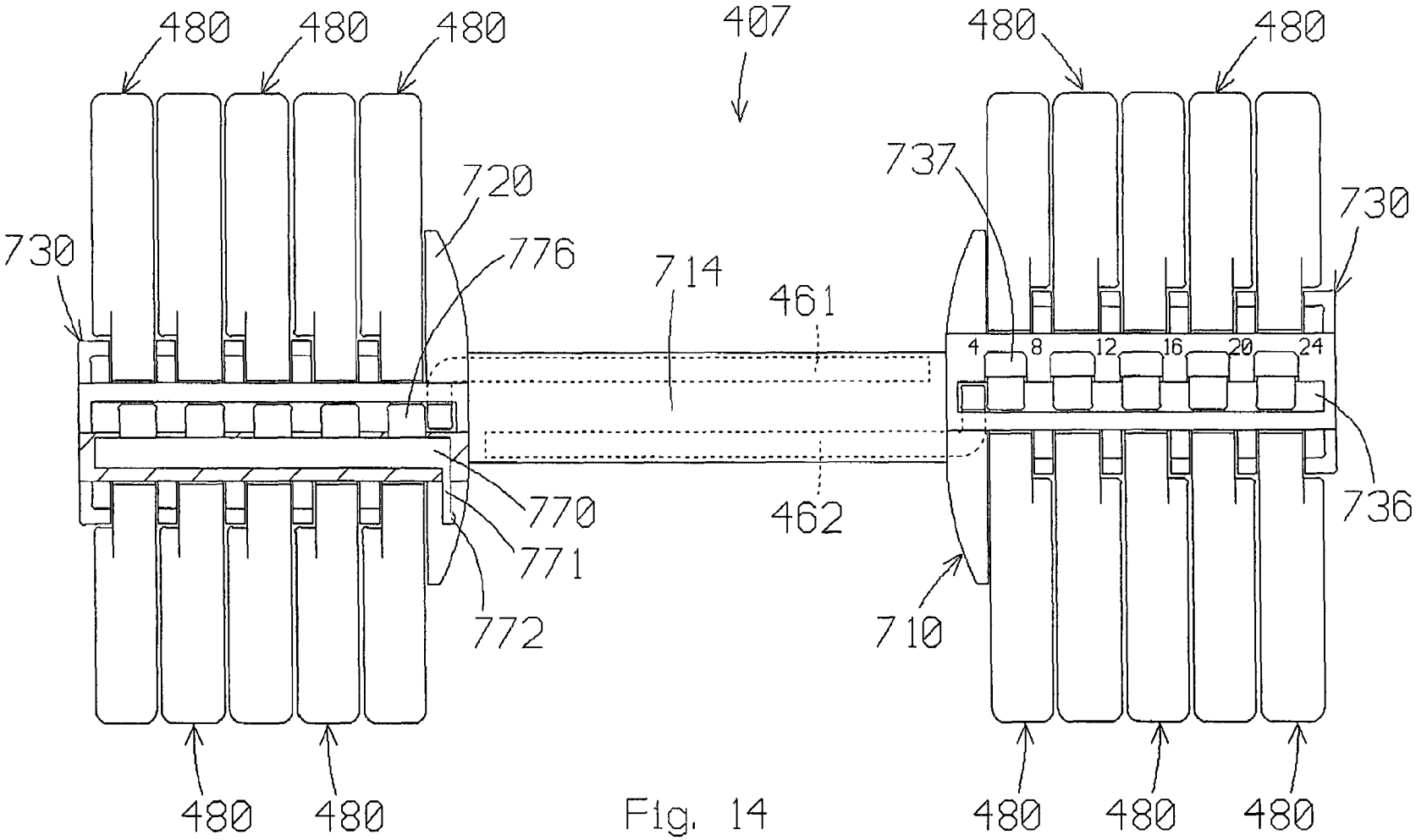
FIG. 14 is a partially sectioned top view of the dumbbell of FIG. 11 modified to include a third weight selector latching arrangement.

FIG. 11 shows an alternative embodiment dumbbell 400 constructed according to the principles of the present invention, and FIGS. 12-14 show the dumbbell 400 modified in different ways to accommodate different means for biasing/latching the associated weight selectors. The dumbbell 400 is similar in many respects to the dumbbell 100, although operational access to the weight selectors 461 and 462 is provided at the same end as the weights 480 engaged by respective weight selectors 461 and 462.

As shown in FIG. 11, each weight selector 461 and 462 is a steel bar or rod having a square cross-section, and bent ninety degrees in two separate places. As a result, a first end section of each weight selector 461 and 462 is axially aligned with handle 414; a second, intermediate section extends perpendicular to the first section and toward a central, longitudinal axis defined by the handle 414; and a third, opposite end section 468 extends perpendicular to the first two sections and away from the central longitudinal axis defined by the handle 414.

As on the previous embodiment 100, first and second weight supporting sections are secured to respective ends of the handle 414 to define a handle member 410. Each weight supporting section includes an inner end plate 420 and a bar 430 configured to engage and support axially aligned weight plates 480. In this regard, each bar 430 includes spacers or fingers 433 that are sized and configured to extend between adjacent weight plates 480, and channels 434 that extend across the fingers 433 to accommodate the first, axially extending section of a respective weight selector 461 or 462. As on the previous embodiment 100, the channels 434 align with notches in the weight plates 480. The weight plates 480 are similar in overall configuration to the weight plates 190*a* and 190*b* described above (with properly configured and arranged notches to receive the weight selectors 461 and 462), and they are preferably supported on a cradle or base similar to the cradle 200 described above.

Each bar 430 also has an upwardly opening slot 436 to accommodate the third, outwardly extending section 468 of a respective weight selector 461 or 462. Also, indicia 439 are provided on top of the bars 430 along the length of the slots 436 to indicate how much the handle member 410 weighs when the outwardly extending sections 468 of the weight selectors 461 and 462 occupy a particular position relative to the indicia 439. The bars 430 are shown as unitary parts, but are preferably made with multiple parts that are formed and interconnected in a manner known in the art.

As suggested by the common reference numerals, FIG. 12 shows a dumbbell 405 that is similar to the dumbbell 400 except to the extent that it has been modified to define discrete positions for weight selectors 561 and 562. In this regard, the weight selectors 561 and 562 are similar to the weight selectors 461 and 462 except that notches 566 are provided in the selectors 561 and 562 at axially spaced intervals along the axially extending sections thereof. Spring detent arrangements are disposed inside respective cavities 515 in the handle 514 to selectively engaged the notches 566. Each spring detent arrangement includes a helical coil spring 544 compressed between an inner end well of the cavity 515 and a rounded nub 556 that is sized and configured to nest inside any of the notches 566. Each nub 556 cooperates with respective notches 566 to position the outwardly extending selector section 568 in alignment with respective indicia 439.

The spring detent arrangements may be described alternatively as biasing means movably mounted on the handle member 510 for biasing each weight selector 561 and 562 toward respective weight selecting positions relative to the handle member 510. Such biasing means accommodate axial movement of either weight selector 561 or 562 without requiring user application of force in any direction other than axially. In other words, a user can simply pull or push axially against the outwardly extending sections 568 of the selectors 561 and 562 in order to engage and disengage the weight plates 480. An ergonomically configured tab or handle may be mounted on the distal end of each section 568 if desired.

As suggested by the common reference numerals, FIG. 13 shows a dumbbell 406 that is similar to the dumbbell 400 except to the extent that it has been modified to define discrete positions for weight selectors (one of which is shown and designated as 662), which are similar to the weight selectors 461 and 462. Only one of the weight selector arrangements is shown for ease of illustration, with the understanding that a similar arrangement is provided to similarly engage the weight plates 480 at the other end of the dumbbell 406.

For each weight selector arrangement, a coil spring 664 is maintained in tension between the distal end of the axially extending section of the weight selector 662 associated with the weight plates 480 at the right end of the dumbbell 406, and the bar 430 associated with the opposite, left end of the dumbbell 406. Each spring 664 biases a respective weight selector (e.g. 662) toward a recessed position within the handle 614.

A plunger or operator member 670 is slidably mounted on the outwardly extending portion of the weight selector 662. Also, a screw or other suitable fastener 676 is secured to the distal end of the outwardly extending portion of the weight selector 662, with a coil spring is disposed inside a bore in the operator member 670, and is compressed between the head of the screw 676 and a wall on the operator member 670. As a result of this arrangement (and in a manner known in the art), the operator member 670 is biased downward toward the handle member 610.

A flange 678 projects laterally outward from the operator member 670, and the flange 678 is configured to fit between adjacent weight plates 480. When the operator member 670 is subject only to the force of the compressed spring disposed inside the operator member 670, the flange 678 is disposed beneath an top edge of the weight plates 480 (in other words, when viewed axially from the left in FIG. 13, the flange 678 is nested behind two of the weight plates 480). When the operator member 670 is pulled upward by a person using the dumbbell 406, the flange 678 rises above the top edge of the weight plates 480 (in other words, when viewed axially in FIG. 13, the flange 678 is now visible above the weight plates 480). As a result of this arrangement (and the tension in spring 664), the operator member 670 may be latched "behind" the outermost weight plate 480 that is engaged by the associated weight selector 662.

These latching arrangements shown in FIG. 13 may be described alternatively in terms of first and second latching means movably mounted on the first weight selector and the second weight selector 662, respectively, for latching each weight selector in respective weight selecting positions relative to respective weights 480. Each such latching means may also be described as selectively movable into radially overlapping relationship with respective weights 480.

As suggested by the common reference numerals, FIG. 14 shows a dumbbell 407 that is similar to the dumbbell 400 except to the extent that it has been modified to define discrete positions for the weight selectors 461 and 462. As shown on the left end of the dumbbell 407, the opposite end bars 730 have been modified to accommodate respective latches 770, which are rotatably mounted therein. Each latch 770 includes a main shaft that is cylindrical, and axially spaced fingers or tabs 776 that extend radially outward from the shaft.

Means are preferably provided to secure the latches 770 in respective latched positions, and/or to bias the latches 770 toward respective latched positions. On the depicted embodiment 407, a leaf spring 771 extends radially away from the main shaft, and a nub 772 is provided on a distal end of the leaf spring 771. The nub 772 is configured to engage a depression in the inner end plate 720 when the latch 770 occupies its latched position. Also, a knob or lever or other suitable operator member (not shown) may be connected to the latch 770 to facilitate rotation thereof relative to the handle member 710. On the depicted embodiment 407, no such member is shown, but a user can access the tabs 776 to rotate the latches 770.

As shown on the right end of the dumbbell 407, the end bars 730 have also been modified to include notches 737 to accommodate the latch tabs 767 (and maintain proper alignment of the latches 770). The latch 770 is rotated to the orientation shown in FIG. 14 to latch the weight selector 462 in any of several weight selecting locations along the handle member 710. In this regard, the latch tabs 767 are configured and arranged to accommodate the outwardly extending section of the selector 462 at specific locations that align with the indicia on the end bar 730. In order to release the selector 462 for movement along the handle member 710, the tabs 776 are rotated away from the selector 462 and further into respective notches 737 in the end bar 730. Those skilled in the art will recognize that, among other things, other sorts of latches, including sliding latches, may be used instead of the rotating latches 770.

Each latch 770 may be described alternatively in terms of being movably mounted on the handle member 710, and selectively movable into radially overlapping relationship with a respective weight selector 461 or 462. Each such latch 770 may be described further as rotatably mounted on the handle member 770 to define a respective axis of rotation, with the fingers 776 extending transversely relative to their respective axis of rotation. Each such latch may also be described as configured to define desired weight engaging positions for a respective weight selector 461 or 462.

The present invention has been described with reference to specific embodiments and particular applications. However, this disclosure may enable those skilled in the art to derive additional embodiments and/or applications that embody the essence of the invention. Among other things, the hand grip and the various supports that comprise the weight supporting sections may be formed as separate parts and then mounted on a bar that extends the length of the handle member. Also, various means may be employed or substituted to hold the various weight selectors in desired positions, including coil springs, leaf springs, and torsional springs, which may be arranged to directly or indirectly engage the selectors and/or to bias the selectors into engagement with the weights or the handle member. Moreover, at least some of the biasing and/or latching means disclosed herein may be implemented on other dumbbells that do not have the selector rods movably mounted inside the handle. Furthermore, the present invention may also be described in terms of various methods of adjusting resistance to exercise, with reference to the embodiments disclosed herein, for example. In view of the foregoing, the scope of the present invention is to be limited only to the extent of the following claims.

What is claimed is:

1. An exercise dumbbell, comprising:

a handle member having a handle that defines a longitudinal axis, a first weight supporting section disposed at a first end of the handle and including a first bar that extends axially through the first weight supporting section, and a second weight supporting section disposed at an opposite, second end of the handle and including a second bar that extends axially through the second weight supporting section;

first weights sized and configured to be supported by the first weight supporting section, and including respective outwardly opening slots to accommodate insertion of the first bar;

second weights sized and configured to be supported by the second weight supporting section, and including respective outwardly opening slots to accommodate insertion of the second bar;

a first weight selector configured and arranged to selectively engage the first weights, wherein the first weight selector extends axially through the handle and is accessible via the slots in the second weights; and a second weight selector configured and arranged to selectively engage the second weights, wherein the second weight selector extends axially through the handle and is accessible via the slots in the first weights.

2. The exercise dumbbell of claim 1, wherein each said weight selector is configured and arranged to span the handle when all of the weights are engaged.

3. The exercise dumbbell of claim 1, wherein the first weights include a first weight plate and a second weight plate, and the second weights include another first weight plate and another second weight plate, and each said weight selector is movable to a respective latched position spanning each said first weight plate.

4. The exercise dumbbell of claim 1, wherein a first operator member is connected to the first weight selector and extends upward through at least one of the slots in the second weights, and a second operator member is connected to the second weight selector and extends upward through at least one of the slots in the first weights.

5. The exercise dumbbell of claim 4, further comprising a means for biasing each said operator member to remain in a desired axial location along the handle member.

6. The exercise dumbbell of claim 5, wherein the means includes a first spring that biases the first operator member downward into one of several notches in the second weight supporting section, and a second spring that biases the second operator member downward into one of several notches in the first weight supporting section.

7. The exercise dumbbell of claim 1, further comprising a base sized and configured to support the weights in respective rest positions that align with the weight supporting sections.

8. A weight lifting apparatus, comprising:

a handle member having a handle that defines a longitudinal axis, a first weight supporting section disposed at a first end of the handle, and a second weight supporting section disposed at an opposite, second end of the handle;

first weights sized and configured to be supported by the first weight supporting section;

second weights sized and configured to be supported by the second weight supporting section;

a first weight selector configured and arranged to selectively engage the first weights, wherein the first weight selector extends axially through the handle and into the second weight supporting section, and is accessible via slots in the second weights; and a second weight selector configured and arranged to selectively engage the second weights, wherein the second weight selector extends axially through the handle and into the first weight supporting section, and is accessible via slots in the first weights.

9. The weight lifting apparatus of claim 8, wherein each said weight selector is configured and arranged to span the handle when all of the weights are engaged.

10. The weight lifting apparatus of claim 8, wherein the first weights include a first weight plate and a second weight plate, and the second weights include another first weight plate and another second weight plate, and each said weight selector is movable to a respective latched position spanning each said first weight plate.

11. The weight lifting apparatus of claim 8, wherein a first operator member is connected to the first weight selector and extends upward through at least one of the slots in the second weights, and a second operator member is connected to the second weight selector and extends upward through at least one of the slots in the first weights.

12. The weight lifting apparatus of claim 11, further comprising a means for biasing each said operator member to remain in a desired axial location along the handle member.

13. The weight lifting apparatus of claim 12, wherein the means includes a first spring that biases the first operator member downward into one of several notches in the second weight supporting section, and a second spring that biases the second operator member downward into one of several notches in the first weight supporting section.

14. The weight lifting apparatus of claim 8, further comprising a base sized and configured to support the weights in respective rest positions that align with the weight supporting sections.

* * * * *